US005353450A

United States Patent [19]

Katan

[11] Patent Number: 5,353,450

[45] Date of Patent: Oct. 11, 1994

[54] HEADBOARDS

[76] Inventor: Joseph M. Katan, 13C St. Mary's Avenue, Finchley, London N3 1SN, Great Britain

[21] Appl. No.: 910,142

[22] PCT Filed: Jan. 16, 1991

[86] PCT No.: PCT/6B91/00064

§ 371 Date: Mar. 16, 1993

§ 102(e) Date: Mar. 16, 1993

[87] PCT Pub. No.: WO91/10386

PCT Pub. Date: Jul. 25, 1991

[30] Foreign Application Priority Data

Jan. 17, 1990 [GB] United Kingdom ..... 9001040
Jul. 31, 1990 [GB] United Kingdom ..... 9016748

[51] Int. Cl.[5] ..... A47C 20/04
[52] U.S. Cl. ..... 5/53.2; 5/634
[58] Field of Search ..... 5/53.2, 53.3, 634, 635

[56] References Cited

U.S. PATENT DOCUMENTS 532,850 1/1895 Wangersheim et al. ..... 5/634
586,674 7/1897 Stretch ..... 5/634

FOREIGN PATENT DOCUMENTS 1252302 12/1960 France .
435886 10/1935 United Kingdom .
738597 10/1955 United Kingdom .
739389 10/1955 United Kingdom ..... 5/53.2
2094138 9/1982 United Kingdom ..... 5/634

*Primary Examiner*—Alexander Grosz
*Attorney, Agent, or Firm*—Mason, Fenwick & Lawrence

[57] ABSTRACT

A bed headboard having a headboard panel and support means supporting the panel in a generally vertical position and in at least one inclined position. The support means includes mounting means secured to the end of the bed and struts pivotally connected at one end to the mounting means at a position aligned with the bed and pivotally connected at its other end to the panel. The headboard preferably includes pivotal movement limiting means for limiting pivotal movement of the struts in at least one direction relative to the panel to maintain the panel in an inclined position. The lower edge of the panel contacts the bed, so that when a person reclines against the headboard, it is further stabilized by the person's weight.

10 Claims, 4 Drawing Sheets

HEADBOARDS

TECHNICAL FIELD

This invention is concerned with headboards for beds.

BACKGROUND ART

Conventionally, a bed headboard comprises a vertical board or panel disposed at the head of the bed, for aesthetic reasons and with a view to minimising draughts, preventing the displacement of pillows and providing support for a person sitting up in the bed.

Various proposals have been made to provide a tilting headboard which gives improved support for a user, see for example GB patent specification No. 739,389 of Percival Lawrence Way and GB patent specification No. 879,720 of Dunlop Rubber Company Limited.

The Percival Lawrence Way specification provides a headboard/back support which is supported on a pair of upright telescopic struts which are hinged at their top ends to the headboard. It is to be expected that the telescopic struts would be subjected to bending stresses in use and would need to be substantially constructed.

In the case of the Dunlop specification a headboard-/back support is hinged near its top edge on a pair of support posts fixed to the bed frame and inclination of the headboard is limited by hinged links fixed to the headboard and to the support posts. The support posts project above the headboard when it is in its inclined position and are thus visible. The posts directly absorb the forces imposed by the user at the level of the hinges i.e. at considerably above the level of the bed. Here again the support posts will need to be substantially constructed.

It is the object of the present invention to provide a tilting headboard which is secure in upright and inclined positions and which is readily adjustable between those positions.

It is another object of the invention to provide a simple and inexpensive tilting mechanism for supporting the headboard which is hidden by the headboard during use.

DISCLOSURE OF INVENTION

According to the invention, a bed headboard comprises a headboard panel and means supporting the panel in a substantially vertical position and in at least one inclined position, the supporting means comprising mounting means adapted to be secured at the end of a bed, characterised in that the upper end of the mounting means is adapted for disposition substantially at the level of the bed surface, and strut means is pivotally connected at a lower end to the upper end of the mounting means and at an upper end to the panel at a position distant from the top and bottom of the panel, the strut means being arranged to extend substantially at right angles to the panel when the panel is in the said one inclined position and further characterised in that the panel is supported when inclined by contact between its lower edge and the bed surface. In this position the lower edge of the panel tends to dig into the mattress on the bed when the user's weight is placed on the panel, so that the panel is retained firmly in its inclined position. It has been found that, surprisingly, this arrangement provides very firm support for the panel in its inclined position and avoids the necessity of parts of the supporting means projecting above the top of the panel in both of its positions. To assist in maintaining the panel in its inclined position, a part of the strut means may abut against the rear of the panel to limit or prevent pivotal movement of the strut means relative to the panel.

Preferably the bed headboard comprises means preventing or limiting pivotal movement of the strut means in at least one direction relative to the panel to maintain the panel in an inclined position and the lower edge of the panel is adapted to contact and rest on the bed whereby it is further stabilised by the weight of the user. The means for preventing or limiting pivotal movement of the strut means relative to the panel may comprise an abutment on the strut means and which engages the panel. Alternatively, the means for preventing or limiting pivotal movement of the strut means relative to the panel may comprise a secondary strut fixed between the panel and the strut means. Preferably the position of the attachment of the secondary strut on the strut means is adjustable to vary the inclination of the panel. The mounting means is preferably so dimensioned that it is not visible from the foot of the bed when the panel is in its different positions. The mounting means also preferably extends above its pivotal connection with the strut means, and is provided near its upper end with means for retaining the headboard panel in a substantially vertical position.

Preferably the mounting means comprises a hinge having first and second parts which are pivotally interconnected for relative articulating movement, and wherein the pivotal interconnection allows relative endwise movement between the parts when they are in a given relative relationship to permit the co-operating parts of a latch disposed on the respective parts to engage to lock the parts in a relatively stationary position. Thus for example, the parts of the hinge can be locked when the parts are aligned or at right angles to one another.

The hinge may be arranged to provide two or more locking positions.

The strut means preferably forms one of the pivotally interconnected parts. Thus the hinge may comprise a strut member, co-axial pivots adjacent one end of the strut member and projecting from opposite sides thereof, co-axial retaining pins spaced away from the pivots and projecting from the opposite sides of the strut member, a bracket in the form of a channel member having a base adapted to be secured to a support and side flanges provided with closed slots extending lengthwise of the flanges, which closed slots contain said pivots slidably therein, the side flanges also being provided at their ends with open-ended slots extending lengthwise of the flanges for removably receiving the retaining pins to lock the strut member in a required position relative to the bracket.

The pivots and the retaining pins may conveniently be provided by the projecting ends of spindle-like members which pass through the strut member.

The base of the channel member may be secured to a wall or other supporting member. In a preferred embodiment, the mounting means comprises a fixing member secured to the channel member by which the mounting means can be secured in position at the head of the bed, e.g., to the bed frame or to an adjacent wall. Preferably, the strut member and the fixing members engage one another when the strut member is in its locked position.

Preferably, the side flanges of the channel members are bevelled or curved adjacent to the open-ended slots to facilitate entry of the retaining pins into those slots.

The invention further provides a structure having associated therewith or connected thereto a hinge as hereinbefore defined, with an aforesaid channel member secured in an upright position with its open-ended slots facing upwardly.

BRIEF DESCRIPTION OF DRAWINGS

A preferred embodiment of the invention, is diagrammatically illustrated by way of example in the accompanying drawings, in which.

BEST MODE FOR CARRYING OUT INVENTION

Figure 1:
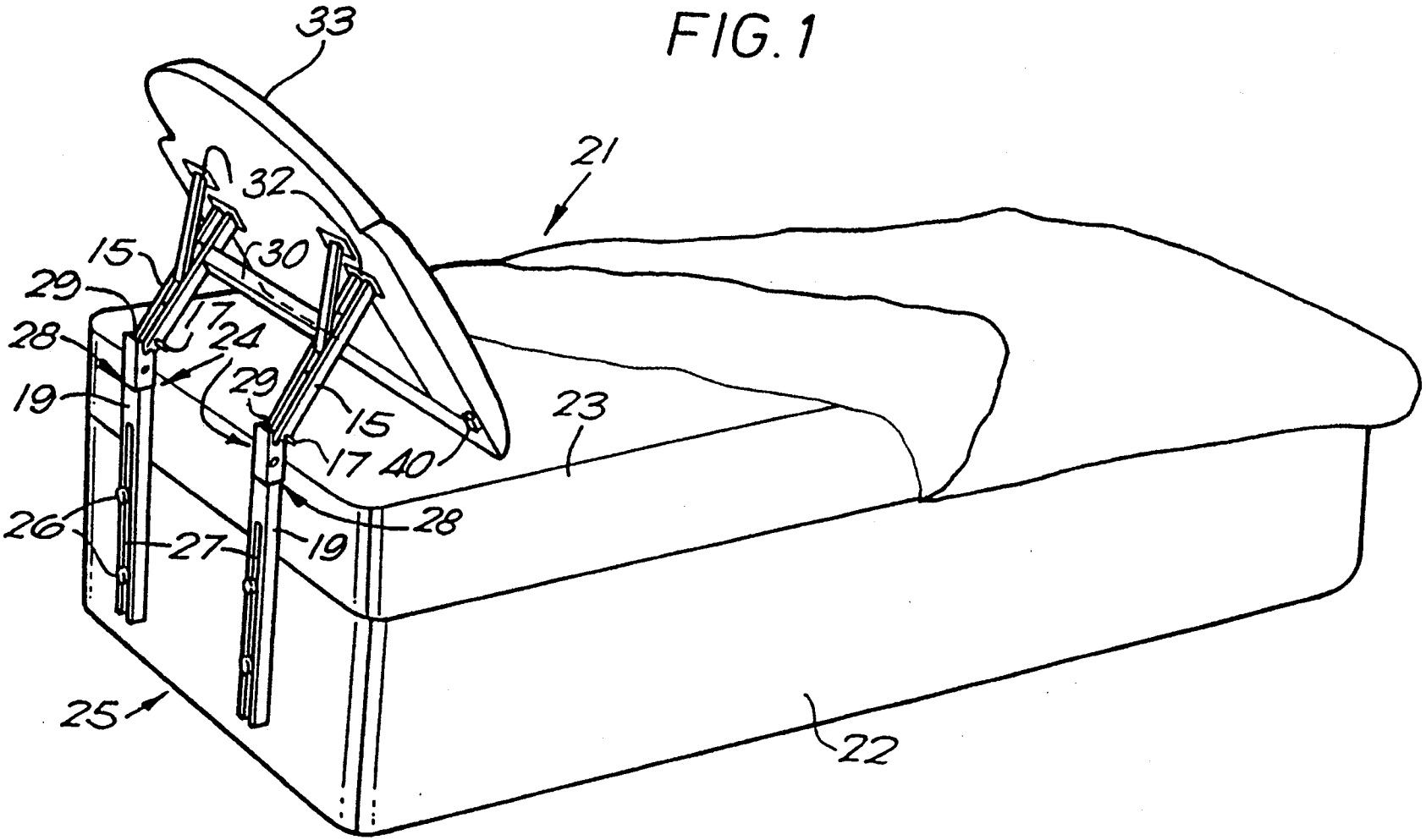
FIG. 1 is a perspective view of a bed fitted with a headboard in accordance with the invention.
Figure 2:
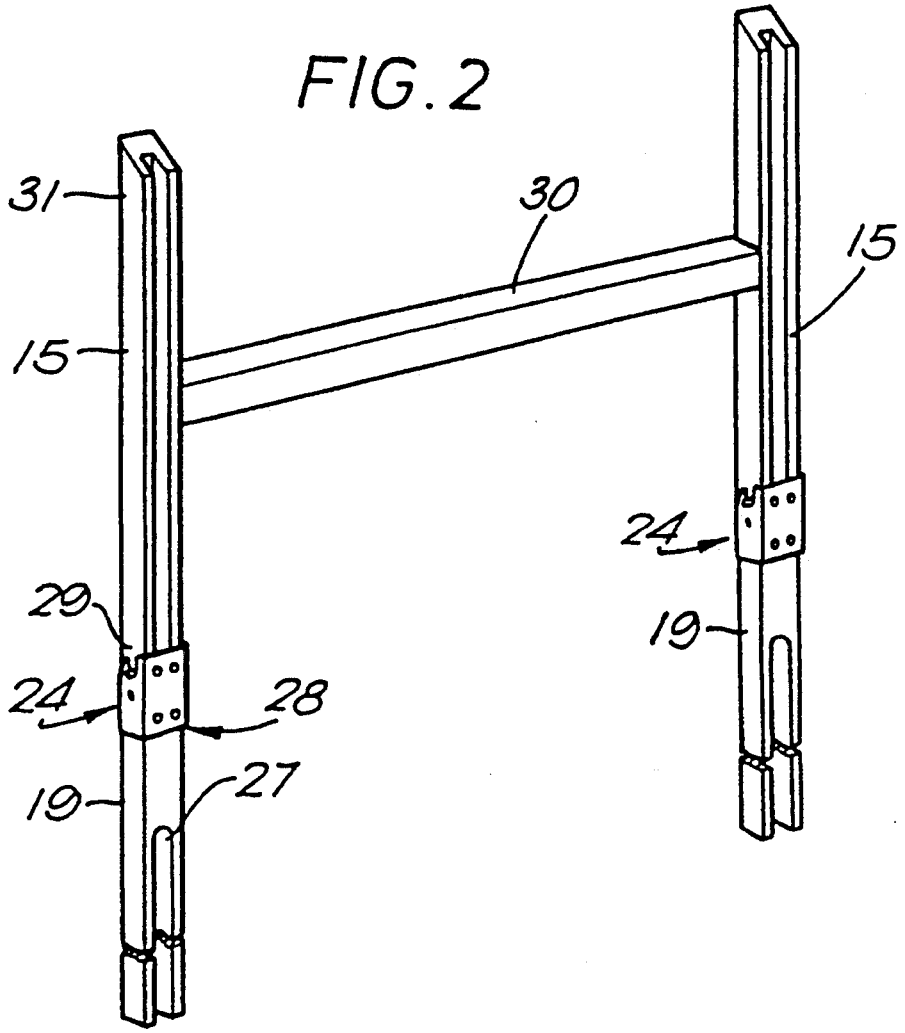
FIG. 2 is a perspective view of part of a supporting means for the headboard of FIG. 1.
Figure 3:
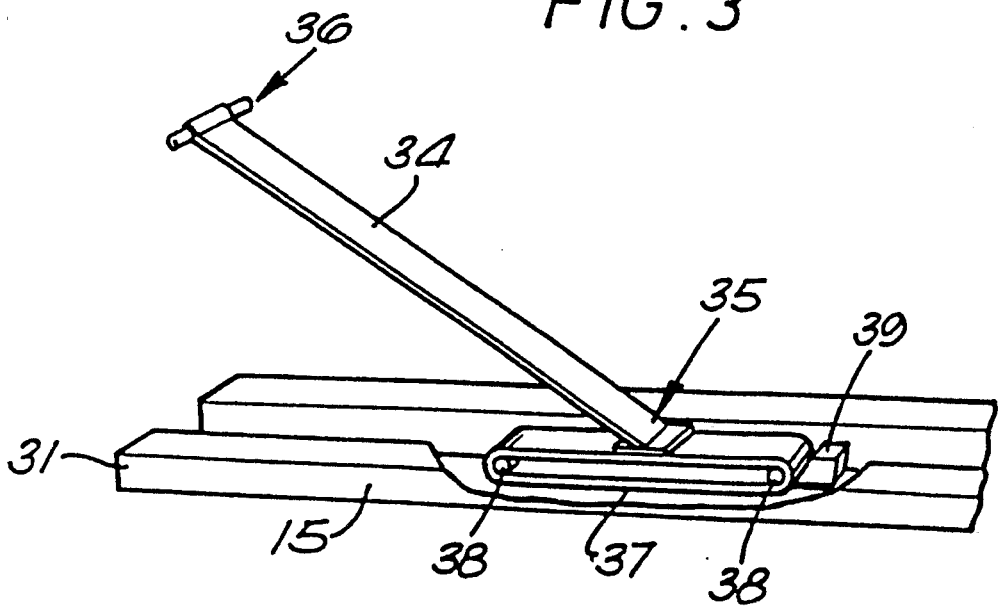
FIG. 3 is perspective view of a part of the supporting means.
Figure 4:
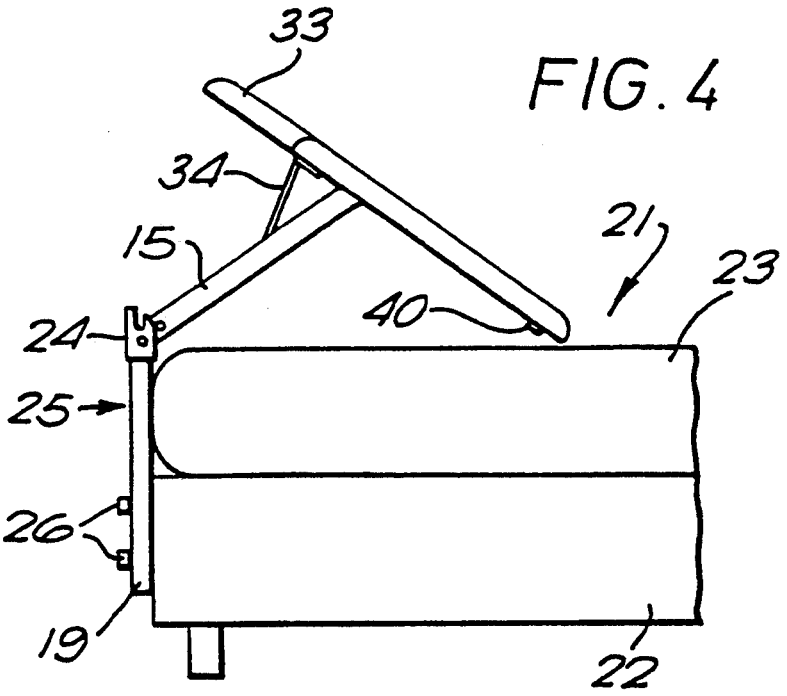
FIG. 4 is a partial side view corresponding to FIG. 1.
Figure 5:
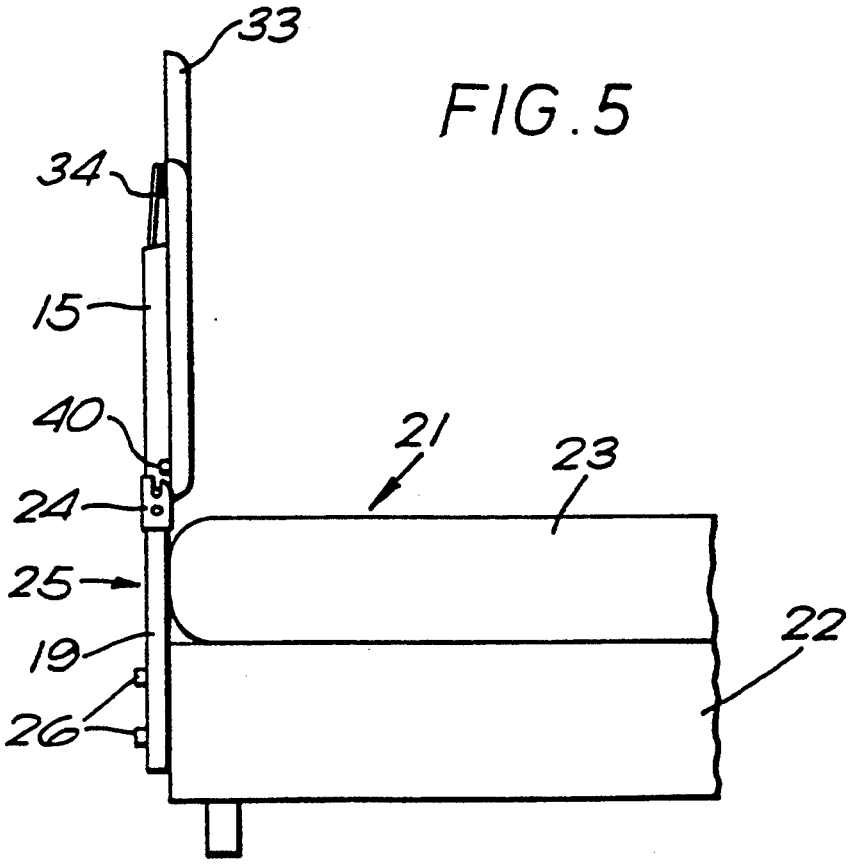
FIG. 5 is a partial side view similar to that of FIG. 4 but showing the headboard in a different operating position.

In the drawings and referring more particularly to FIGS. 1 to 5 there is shown a divan bed 21 comprising a base 22 covered by a mattress 23. At the head 25 of the bed a pair of upright headboard mounting members 19 are fixed to the base 22 in conventional fashion by means of pairs of screws or bolts 26 engaged in slots 27 in the upright members 19 whereby the vertical positions of the upright members can be adjusted so that their upper ends 28 are disposed substantially at the level of the top of the mattress 23. The upper ends 28 of the upright members 19 carry hinges 24, more fully described below with reference to FIGS. 6 and 7 of the drawings, which carry the lower ends 29 of a pair of struts 15 which are interconnected by a cross member 30 and which together form a strut means. The upper ends 31 of the struts 15 are connected by hinges 32 to the rear of a headboard panel 33 substantially midway between the top and bottom edges of the panel. The arrangement is such that the struts 15 may be pivoted from the position shown in FIGS. 1 and 4 in which they support the headboard panel in an inclined position, to a second position as shown in FIG. 5 in which the headboard is disposed vertically at the end of the bed.

Preferably the angle of inclination of the headboard panel may be adjusted by the user by means of secondary struts 34 articulated at their upper ends 36 on the headboard panel 33 above the main struts 15 and connected at their lower ends 35 to the main struts 15 so as to be adjustable in position lengthwise of the main struts 15. Thus for example the lower ends 35 of the secondary struts 34 may be mounted on endless members in the form of belts 37 (see FIG. 3) trained over end rollers 38 in the main struts 15 so that the attachment position of the secondary strut 34 with respect to the main strut 15 is adjustable along the main strut 15. Brake means 39 is provided for locking the endless belt 37 in any desired position. Preferably the brake means 39 is actuated by a control lever 40 disposed near one corner of the lower edge of the panel 33 for use by the occupant of the bed, without having to get out of bed.

In a headboard where the angle of inclination of the headboard is not to be adjustable, the strut 15 is disposed substantially at right angles to the headboard panel 33 when the panel 33 is inclined. Preferably the upper end of the strut 15 is arranged to abut the panel 33 when it reaches an angle of 90°, to prevent further hingeing movement of the strut 15.

Figure 6:
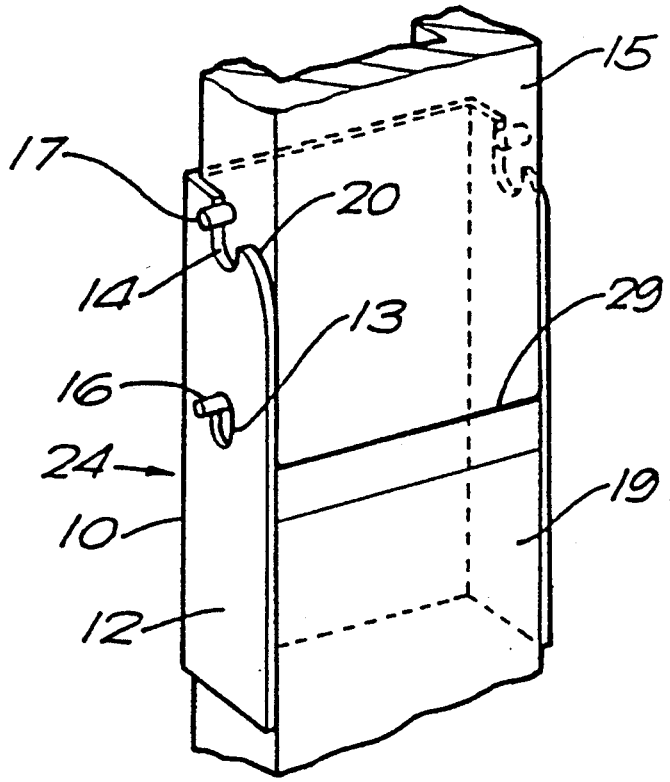
FIG. 6 is a perspective view of a hinged strut forming part of the supporting means.
Figure 7:
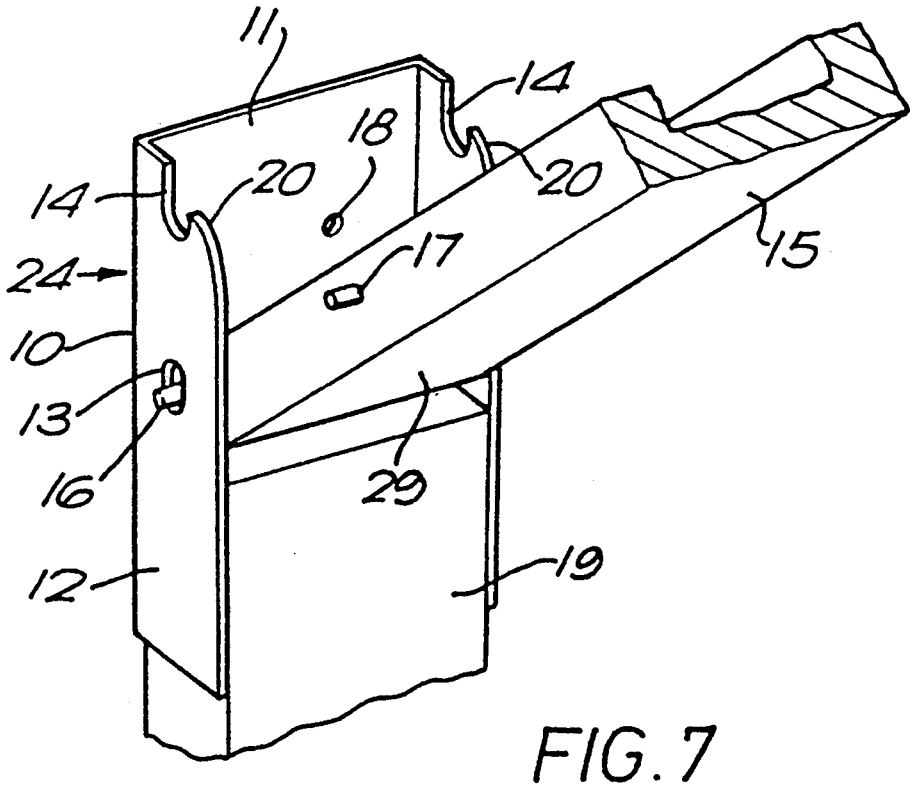
FIG. 7 is a perspective view of the hinged strut of FIG. 6 in a different position.

The hinge 24 shown in FIGS. 6 and 7 of the drawings comprises a channel member 10 having a base 11 and a pair of parallel side flanges 12. The side flanges 12 have closed slots 13 extending lengthwise in the flanges 12 and open-ended slots 14 at the upper ends of flanges 12. The slots 13 and 14 in each flange 12 are aligned with each other. The lower end 29 of the strut member 15 to be connected to the hinge 24 is formed with coaxial pivots 16 projecting from opposite sides of strut member 15. The pivots 16 are conveniently provided by the opposite ends of a spindle or shaft which passes through the strut member 15. The pivots engage slidably and rotatably in the closed slots 13 in the bracket 10. The strut member 15 also carries, spaced away from the pivots 16, coaxial retaining pins 17 projecting from opposite sides. The retaining pins 17 are conveniently provided by opposite ends of a spindle or shaft which passes through the strut member 15. The base 11 has holes 18 for the passage of securing screws. An upright headboard mounting member 19 is fastened in the channel member 10 below the slots 13 by screws (not shown) passing through holes 18.

In use, the strut member 15 can be swung into a upright position as shown in FIGS. 5 and 6 about its pivots 16. This movement is facilitated by the provision of curved portions 20 of the upper ends of the flanges 12. The retaining pins 17 are then allowed to descend in the open-ended slots 14, the pivots 16 permitting this movement by downwards movement in their slots 13. Engagement of the retaining pins 17 in the slots 14 locks the strut member 15 in an aligned position with respect to the mounting member 19 as shown in FIG. 6 so that the headboard panel 33 is locked in its upright position. When it is desired to incline the headboard panel 33 into the position shown for example in FIGS. 1 and 4 the strut member 15 is lifted so that the retaining members 17 clear the slots 14 and the strut member 15 is swung on its pivots 16 into an inclined position as shown in FIG. 7. The end of the strut member 15 may be rounded or otherwise formed to facilitate the swinging movement.

Holes 18 in the base 11 of the channel member 10 may be used for the passage of screws to fasten the hinge to a wall where it is not wished to fix the headboard directly to a bed.

The headboard of the invention may be used on a single or on a double bed, but when used on a double bed it is preferred that the headboard is split so that a separately moveable panel is provided for each occupant of the bed.

INDUSTRIAL APPLICABILITY

The invention thus provides a simple, unobtrusive and effective mechanism for mounting a bed headboard so that it can be moved between upright and inclined positions.

I claim:

1. A bed headboard comprising:

a headboard panel having a top and a bottom;

supporting means for supporting said panel in a substantially vertical position and an inclined position, said supporting means comprising mounting means for mounting said panel at one end of a bed, said mounting means having an upper end for disposition substantially at the level of the surface of the bed, and struts each having upper and lower ends and being pivotally connected at said lower end to said upper end of said mounting means and being pivotally connected at said upper end to said panel at a position distant from said top and bottom of said panel, said struts being positioned to extend substantially at right angles to said panel when said panel is in said inclined position.

2. The headboard of claim 1, further comprising pivotal movement limiting means for limiting pivotal movement of said struts in at least one direction relative to said panel for maintaining said panel in an inclined position, and wherein said bottom of said panel is configured to contact the bed, whereby it is further stabilized by the weight of a user.

3. The headboard of claim 2, wherein said pivotal movement limiting means comprises an abutment on said upper ends of said struts, said abutment engaging said panel.

4. The headboard of claim 2, wherein said pivotal movement limiting means comprises secondary struts each having first and second ends, said first end being articulated on said panel and said second end being attached to a respective one of said struts.

5. The headboard of claim 4, wherein said second end of each said secondary strut is adjustably attached to a respective one of said struts, whereby the inclination of said panel is adjustable.

6. The headboard of claim 1, wherein said mounting means is so dimensioned that it is wholly disposed behind said panel irrespective of the inclination of said panel.

7. The headboard of claim 1, wherein said mounting means has an upper end extending above its pivotal connection with said struts, and wherein said mounting means further comprises retention means located at said upper end of said mounting means for retaining said panel in said substantially vertical position.

8. The headboard of claim 1, wherein said mounting means further comprises a hinge having first and second parts pivotally interconnected for relative articulating movement, and a latch having first and second cooperating parts disposed on said first and second parts, wherein the pivotal interconnection between said first and second parts allows relative endwise movement between said first and second parts when they are in a given relative relationship to permit said first and second cooperating parts of said latch to engage to lock said first and second parts relatively stationary.

9. The headboard of claim 8, wherein said struts form part of, or are attached to, one of said first and second pivotally interconnected parts.

10. The headboard of claim 9, wherein said hinge comprises:

first and second co-axial pivots adjacent one end of said struts and projecting from opposite sides thereof;

first and second co-axial retaining pins spaced apart from said co-axial pivots and projecting from opposite sides of said struts;

a bracket having first and second side flanges having upper and lower ends, said flanges being connected to a base and extending outwardly from said base to define a channel;

first and second closed slots extending lengthwise of said flanges, said slots slideably receiving said pivots; and first and second open-ended slots extending lengthwise of said flanges, said open-ended slots removably receiving said retaining pins, to lock said struts in a required position relative to said bracket.

* * * * *